US007281976B2

(12) United States Patent
Okada et al.

(10) Patent No.: US 7,281,976 B2
(45) Date of Patent: Oct. 16, 2007

(54) GAMING MACHINE

(75) Inventors: Kazuo Okada, Koto-ku (JP); Jun Fujimoto, Koto-ku (JP)

(73) Assignee: Aruze Corporation, Tokyo (JP)

( * ) Notice: Subject to any disclaimer, the term of this patent is extended or adjusted under 35 U.S.C. 154(b) by 881 days.

(21) Appl. No.: 10/740,689

(22) Filed: Dec. 22, 2003

(65) Prior Publication Data

US 2004/0152506 A1 Aug. 5, 2004

(30) Foreign Application Priority Data

Dec. 24, 2002 (JP) ..... 2002-371726

(51) Int. Cl.
*A63F 9/24* (2006.01)

(52) U.S. Cl. ..... 463/16; 463/23; 463/30; 273/119 R; 273/121 B

(58) Field of Classification Search ..... None
See application file for complete search history.

(56) References Cited

U.S. PATENT DOCUMENTS 6,203,008 B1 3/2001 Krise et al.
6,220,593 B1 4/2001 Pierce et al.

FOREIGN PATENT DOCUMENTS

| | | |
|---|---|---|
| EP | 0 694 892 A1 | 1/1996 |
| GB | 943545 | 12/1963 |
| JP | 8 215375 | 8/1996 |
| JP | 08-215375 | 8/1996 |
| JP | 2003-199884 | 7/2003 |

*Primary Examiner*—Mark Sager
(74) *Attorney, Agent, or Firm*—Snider & Associates; Ronald R. Snider

(57) ABSTRACT

A gaming machine comprises a game board 3 formed from a light-transparent member; a projecting device 42 for projecting a game medium onto the game board; a plurality of entrances 10 adapted to receive the game medium projected onto the game board; a display device 4 having a game proceeding/result display area 18 for displaying a plurality of first identification information items in a predetermined mode and entrance number display areas 17*a* to 17*p* adapted to display respective second identification information items corresponding to the entrances 10*a* to 10*p*, the display device being disposed such that the display areas are viewable through the game board 3; an online number arrangement changing button 7 for making an instruction to change the display of the display areas; and online number arrangement determining means 58 for receiving the instruction from the online number arrangement changing button 7 for a predetermined period, and changing the display of the display areas according to thus received instruction.

24 Claims, 14 Drawing Sheets

(Transparent Game Board)

(Display Screen of LCD)

(Sectional View of Transparent Game Board and LCD)

Start Arrange Ball Game(Insert Coin)

Ball Enters 9th Entrance(1st Ball)

Ball Enters 16th Entrance(10th Ball)

FIG. 7

Entrance Corresponding Display No. Storing Table
(Example Corresponding to Fig. 6B)

| Entrance | Display No. |
|---|---|
| 1st (10a) | 3 |
| 2nd (10b) | 8 |
| 3rd (10c) | 5 |
| 4th (10d) | 13 |
| 5th (10e) | 1 |
| 6th (10f) | 15 |
| 7th (10g) | 7 |
| 8th (10h) | 12 |
| 9th (10i) | 9 |
| 10th (10j) | 2 |
| 11th (10k) | 11 |
| 12th (10l) | 16 |
| 13th (10m) | 6 |
| 14th (10n) | 14 |
| 15th (10o) | 10 |
| 16th (10p) | 4 |

FIG. 8

Online Address Corresponding No. Storing Table (Example Corresponding to Fig. 6B)

| Address on Line | Display No. | Ball Entered |
|---|---|---|
| $L_{11}$ | 9 | Yes |
| $L_{12}$ | 7 | No |
| $L_{13}$ | 11 | No |
| $L_{14}$ | 4 | Yes |
| $L_{21}$ | 2 | No |
| $L_{22}$ | 16 | Yes |
| $L_{23}$ | 13 | No |
| $L_{24}$ | 6 | No |
| $L_{31}$ | 5 | No |
| $L_{32}$ | 10 | No |
| $L_{33}$ | 1 | Yes |
| $L_{34}$ | 15 | No |
| $L_{41}$ | 14 | No |
| $L_{42}$ | 3 | No |
| $L_{43}$ | 8 | No |
| $L_{44}$ | 12 | No |

(Main Game Control Process)

(Arrange Ball Game Process)

(Display Switching Process)

(Finish Determining Process)

GAMING MACHINE

RELATED APPLICATIONS

This application claims the priority of Japanese Patent Application No. 2002-371726 filed on Dec. 24, 2002, which is incorporated herein by reference.

BACKGROUND OF THE INVENTION

1. Field of the Invention

The present invention relates to a gaming machine for playing a game such as arrange ball, which encompasses not only gaming machines installed in game halls (arcades) but also those playing similar games on screens such as TV.

2. Description of the Prior Art

In a ball gaming machine providing a player with a right to project a predetermined number of game balls to a game area on a game board in a game, i.e., so-called arrange ball gaming machine, an entrance number display device which displays numbers from 1 to 16 in a matrix of 4 by 4 is disposed at the center of the game area. Also, 16 entrances numbered from 1 to 16, respectively, are disposed below the game area. It has been known to light the number identical to that of an entrance having received a game ball, and the game is finished when thus lit numbers align vertically, horizontally, or obliquely, whereby a prize or the like is given to the player (see, for example, Japanese Unexamined Patent Publication No. HEI 8-215375).

In such an arrange ball gaming machine, the numbers attached to the entrances and the numbers of the entrance number display device displayed in the matrix of 4 by 4 are fixedly arranged, however, whereby the game is likely to become monotonous and appear boring to the player.

On the other hand, the degree of difficulty in making the game ball enter (possibility of the ball entering) the individual entrances may vary depending on the positions where the entrances are disposed with respect to the game area, the arrangement of nails on the game board, and the like. Namely, there are entrances where the ball is easier and harder to enter, respectively, which keeps the game from being finished or allows the game to finish only along a specific line.

SUMMARY OF THE INVENTION

It is an object of the present invention to provide a gaming machine which can enhance the joy of playing games.

The gaming machine in accordance with the present invention comprises a game board formed from a light-transparent member; game medium projecting means for projecting a game medium onto the game board; a plurality of entrances adapted to receive the game medium projected onto the game board; display means having a first display area for displaying a plurality of first identification information items in a predetermined mode and a second display area adapted to display respective second identification information items corresponding to the entrances, the display means being disposed such that the first and second display areas are viewable through the game board; instructing means for making an instruction to change the display of at least one of the first and second display areas; and display changing means for receiving the instruction from the instructing means for a predetermined period and changing the display according to thus received instruction.

In the gaming machine of the present invention, the display changing means receives the instruction from the instructing means for a predetermined period, and changes the display of the first or second display area according to thus received instruction. For example, by making an instruction with the instructing means, the player can change the display of at least one of the first and second display areas for a predetermined period. When the display of at least the first display area is changed, for example, a plurality of the first identification information items change, so that the game does not become monotonous, which enhances the joy of playing games. When the display of the second display area is changed, a second identification information item corresponding to an entrance where the game medium is easier to enter or an entrance where the game medium is harder to enter changes, for example, whereby the deviation of this second identification item can be reduced. When an area between the first and second display areas is utilized for displaying a presentation, for example, the relationship between the first and second display areas and the like can be indicated, which further enhances the joy of playing games.

Examples of the first identification information items are numbers, letters, and characters.

Examples of the predetermined mode include two- and three-dimensional display modes.

The first display area is an area displaying a plurality of identification information items at respective addresses in a matrix of 4 by 4, for example, which is specifically a game proceeding/result display area.

An example of the second display area is an entrance number display area.

An example of the display means is a liquid crystal display device.

For example, the display of at least one of the first and second display areas comprises respective identification information items displayed at individual addresses or respective identification information items corresponding to the individual entrances.

For example, the instructing means is an online number arrangement changing button or entrance display number changing button operable by a player.

For example, the predetermined period is a period during when the display can be changed, the period being started from when the game medium is allowed to project or when the game medium is projected.

For example, the display changing means comprises online number arrangement determining means and game proceeding/result display area display determining means, or entrance display number determining means and display mode determining means for an entrance number display area.

In a specific aspect of the present invention, the gaming machine further comprises gaming value providing means for providing a player with a gaming value; and projection allowing means for allowing a predetermined number of game media to project in a game unit for projecting the predetermined number of game media onto the game board; wherein the mode of displaying the first identification information item corresponding to the second identification information item corresponding to the entrance having received the game medium during the game unit is changed in the first display area; and wherein the gaming value providing means provides the player with the gaming value according to the display of the first display area in the game unit.

In this aspect, the mode of displaying the first identification information item conforming to the second identification information item corresponding to the entrance having received the game medium during the game unit is changed.

The gaming value providing means provides the player with the gaming value according to the display of the first display area in the game unit. Therefore, having grasped the current display of the first display area during the game unit, the player can enjoy playing the game while expecting the gaming value which can be provided when the display changes.

An example of the gaming value providing means is a coin dispenser.

An example of the first identification information item is a number or letter identical to a number or letter of the second identification information item.

An example of the change in the mode of displaying the first identification information item is lighting in an online number display area of an address displaying the first identification information item.

For example, the gaming value is provided according to a determination of finish determining means for determining whether a game is finished or not according to information stored in an online address corresponding number storing table.

In a specific aspect of the present invention, the predetermined period is a period after the projection allowing means allows a game medium to project until the game medium projecting means projects the game medium.

In this case, the player can change the display of the first or second display area to a desirable one at the time of starting a game and then play the game. Also, the display of these display areas can be changed when starting the game, thus eliminating the problem of conventional gaming machines yielding an impression of playing monotonous games.

In a specific aspect of the present invention, the predetermined period is started when the game medium projecting means projects a specific number of game media.

In this case, a second identification information item displayed in conformity to an entrance which is hard to receive the game medium can be displayed so as to correspond to an entrance which can easily receive the game medium during a game, for example, thus making it easier to finish the game. Even if there is no possibility of finishing the game when projecting a specific number of game media, for example, such a possibility may occur, thereby enhancing the joy of playing games.

In a specific aspect of the present invention, the specific number is the same as the predetermined number.

In this case, even when a game is not finished at the time when the game ends or after the game ends, a possibility of finishing the game may be generated by manipulating operating means, whereby the player's expectation for finishing the game can be kept until the game ends or after the game ends.

In a specific aspect of the present invention, the display changing means changes the display of at least one of the first and second display areas to a display advantageous to the player in response to an instruction from the instructing means.

In this case, the player's expectation for so-called reach state or finish can be enhanced.

BRIEF DESCRIPTION OF THE DRAWINGS

FIG. 7 is a view showing an entrance corresponding display number storing table;

FIG. 8 is a view showing an online address corresponding number storing table;

DESCRIPTION OF THE PREFERRED EMBODIMENTS

In the following, embodiments of the present invention will be explained in detail with reference to the drawings.

The gaming machine (arrange ball gaming machine) 1 in accordance with an embodiment of the present invention will now be explained. Though the gaming machine 1 is one playing a game while using a gaming medium such as coin, medal, and token, or a gaming medium such as a card stored with information of a gaming value given or to be given to a player, the gaming machine will be explained in the following as one using coins. When a predetermined number of coins are inserted, the gaming machine 1 can yield a right to project a predetermined number of (e.g., 16) game balls among game balls enclosed within the gaming machine 1 (a right to play a game (game unit).

Figure 1:
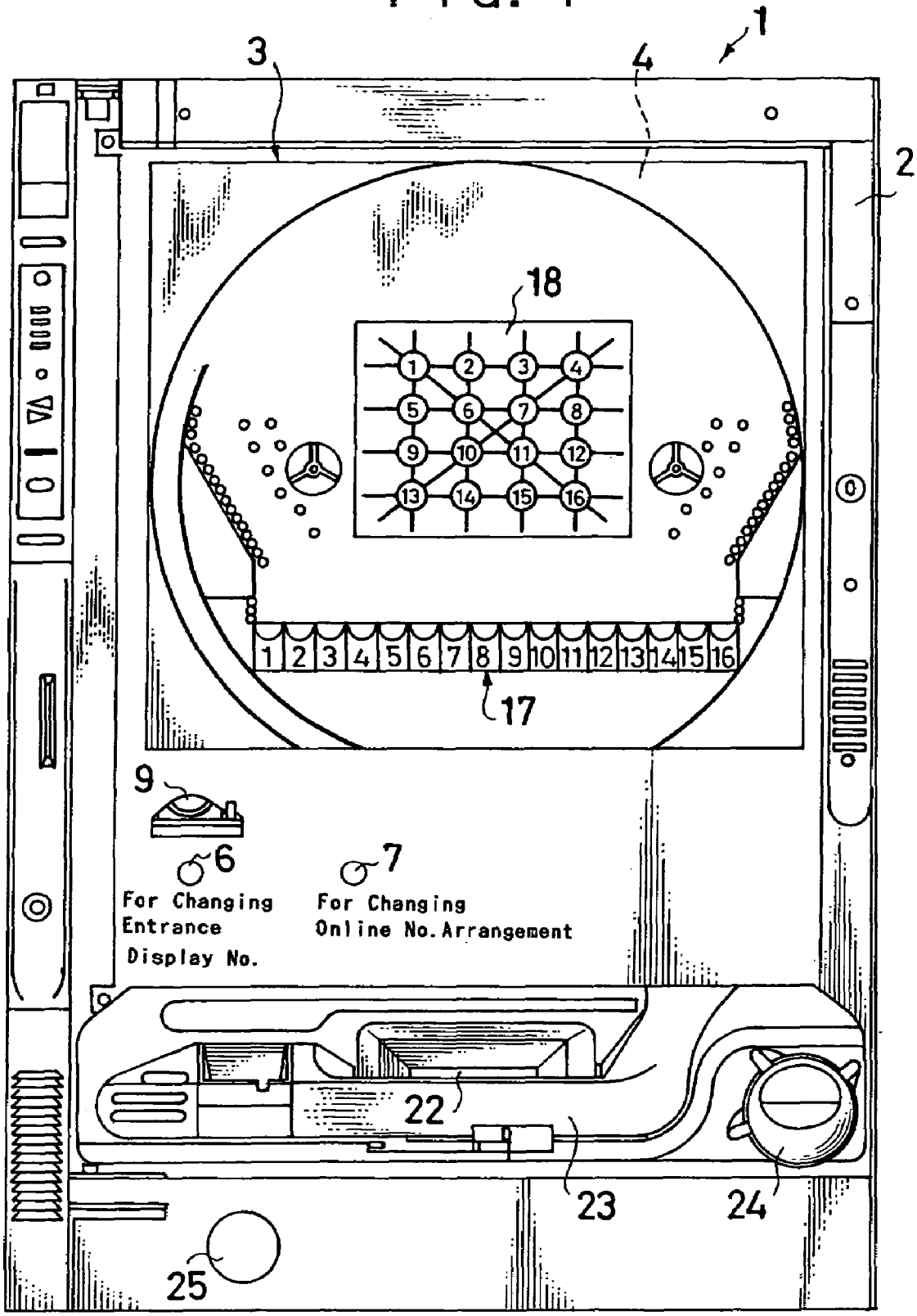
FIG. 1 is a front view of the gaming machine in accordance with an embodiment of the present invention.

FIG. 1 is a front view showing the gaming machine 1. Disposed inside a front door 2 provided with a transparent glass sheet is a transparent game board 3 formed from a light-transparent member made of an acrylic resin. Disposed on the transparent game board 3 are entrances, nails, pinwheels, rails, and the like. Disposed on the backside of the transparent game board 3 as seen from the player is a liquid crystal display device 4 acting as display means for displaying results of games and the like. The display screen (display) of the liquid crystal display device 4 can be seen through the glass sheet attached to the front door 2 and the transparent game board 3. Details of the transparent game board 3 and liquid crystal display device 4 will be explained later.

Below the glass sheet attached to the front door 2, an entrance display number changing button 6, an online number arrangement changing button 7, and a coin insertion slot 9 are provided. The entrance display number changing button 6 and online number arrangement changing button 7 will be explained later. When a coin is inserted into a coin insertion slot 9, a game (game unit) can be carried out. Disposed below the entrance display number changing button 6 and online number arrangement changing button 7 are a payout chute 22 for paying out coins, a payout tray 23 for storing the coins paid out from the payout chute 22, a shooting handle 24 acting as operating means for projecting game balls onto the transparent game board 3, a speaker 25 for outputting various sounds such as background music, etc.

Figure 2:
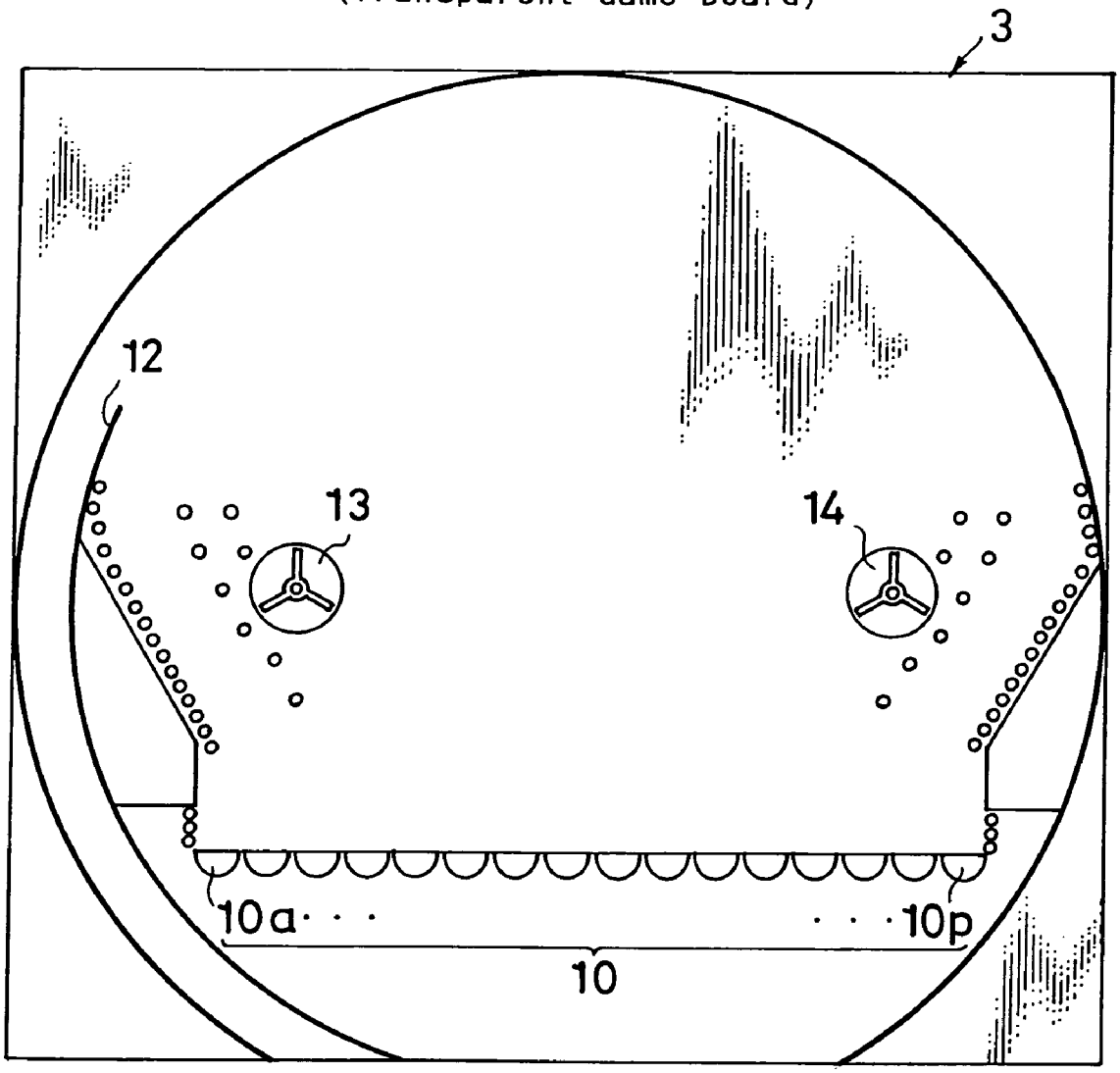
FIG. 2 is a front view showing under magnification the transparent game board of the gaming machine shown in FIG. 1.

With reference to FIG. 2, the transparent game board 3 will now be explained. In the lower part of the transparent game board 3, 1st to 16th entrances 10*a* to 10*p* are provided. As will be explained later, ball entrance detecting switches 10Sa to 10Sp for detecting the entrance of game balls are provided within the entrances 10*a* to 10*p*, respectively. A rail 12 is placed on the left side of the transparent game board 3. Game balls projected from a projecting device 42, which will be explained later, move up along the rail 12 and reach a game area (where the game balls are movable) in the transparent game board 3. A left pinwheel 13 and a right pinwheel 14 are disposed on the left and right sides of the transparent game board 3, respectively.

Figure 3:
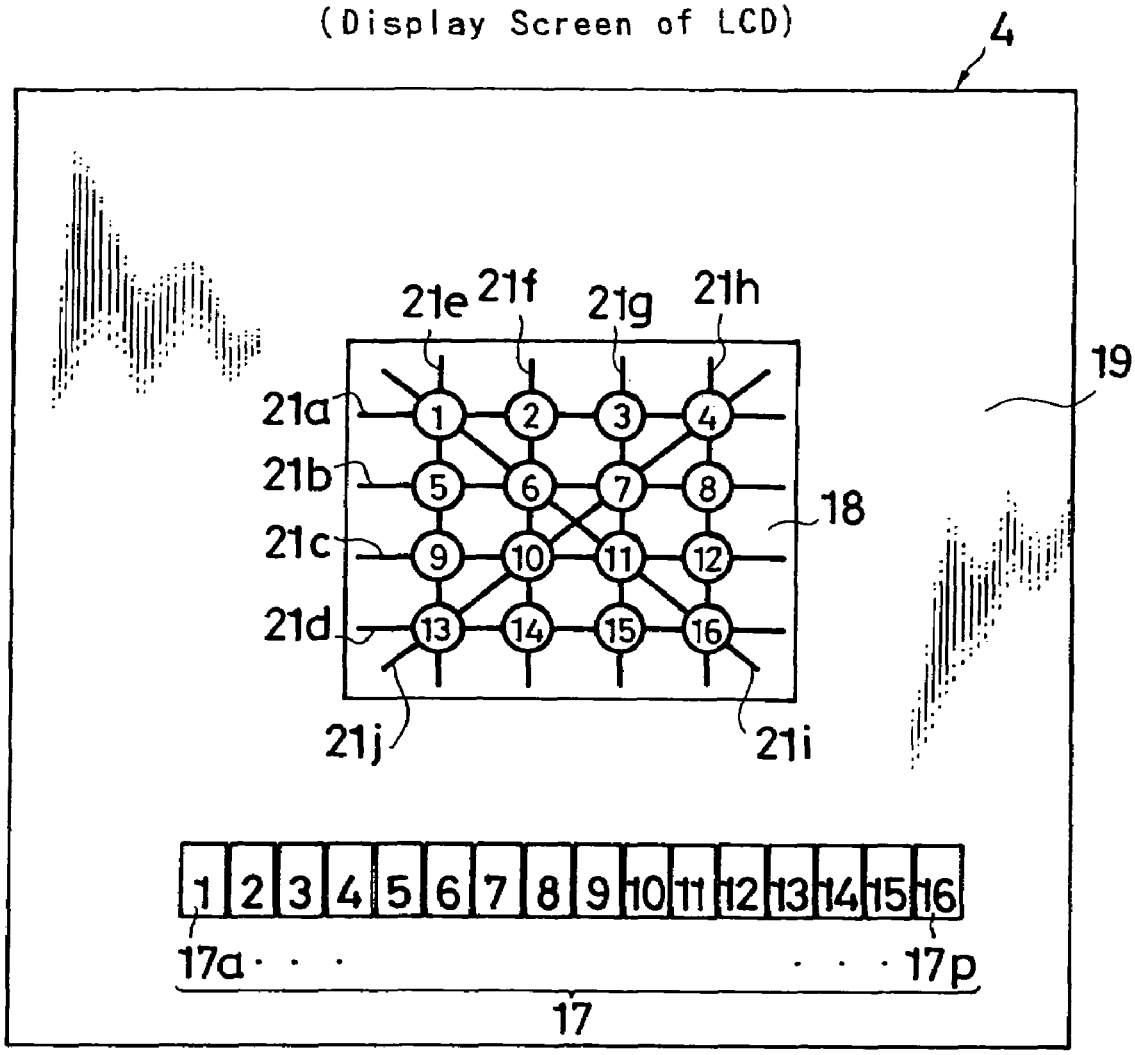
FIG. 3 is a view showing a display screen of a liquid crystal display device of the gaming machine shown in FIG. 1.

With reference to FIG. 3, the display screen of the liquid crystal display device 4 will now be explained. The display screen of the liquid crystal display device 4 is divided into entrance number display areas 17*a* to 17*p*, a game proceeding/result displaying area 18, and a picture display area 19.

The 1st to 16th entrance number display areas 17*a* to 17*p* display numbers 1 to 16. On the display screen of the liquid crystal display device 4, the display areas 17*a* to 17*p* are located at respective positions corresponding to the entrances 10*a* to 10*p* provided in the transparent game board 3. Specifically, the display areas 17*a* to 17*p* are arranged such that the entrances 10*a* to 10*p* are respectively positioned thereabove. As a consequence, the numbers displayed in the display areas 17*a* to 17*p* (second identification information items such as numbers) appear to correspond to the entrances 10*a* to 10*p*, respectively (FIG. 1). When a game ball enters any of the entrances 10*a* to 10*p*, the display area 17*a* to 17*p* corresponding to this entrance is lit. The numbers displayed in the display areas 17*a* to 17*p* can be changed by manipulating the entrance display number changing button 6 (instructing operation). Information indicating the relationship between the entrances 10*a* to 10*p* and the numbers displayed in the display areas 17*a* to 17*p* is stored in an entrance number display storing table which will be explained later (FIG. 7).

The game proceeding/result display area 18 is provided with four horizontal lines 21*a* to 21*d*, four vertical lines 21*e* to 21*h*, and two oblique lines 21*i*, 21*j* as winning lines. At positions where the horizontal lines 21*a* to 21*d* and the vertical lines 21*e* to 21*h* intersect, circled online number display areas are provided. In the online number display areas, the numbers corresponding to those displayed in the entrance number display areas 17*a* to 17*p* are displayed. For identifying these online number display areas (addresses), the four display areas on the line 21*a* will be referred to as $L_{11}$, $L_{12}$, $L_{13}$, $L_{14}$ successively from the left side, the four display areas on the line 21*b* will be referred to as $L_{21}$, $L_{22}$, $L_{23}$, $L_{24}$ successively from the left side, the four display areas on the line 21*c* will be referred to as $L_{31}$, $L_{32}$, $L_{33}$, $L_{34}$ successively from the left side, and the four display areas on the line 21*d* will be referred to as $L_{41}$, $L_{42}$, $L_{43}$, $L_{44}$ successively from the left side.

When a game ball enters any of the entrances 10*a* to 10*p*, the online number display area displaying the number displayed in the entrance number display area 17*a* to 17*p* corresponding to this entrance 10*a* to 10*p* is lit. The numbers displayed in the online number display areas can be changed by manipulating the online number arrangement changing button 7 (instructing operation). The information of numbers and the like displayed in the online number display areas identified by addresses as mentioned above is stored in an online address corresponding number storing table which will be explained later (FIG. 8). When all of the four online number display areas are lit in at least one of the winning lines 21*a* to 21*j* each provided with the four online number display areas, a game is finished, whereby a predetermined number of coins are given (paid out) to the player.

The picture display area 19 is an area excluding the entrance number display areas 17*a* to 17*p* and the game proceeding/result display area 18, and shows decorative images and the like.

Figure 4:
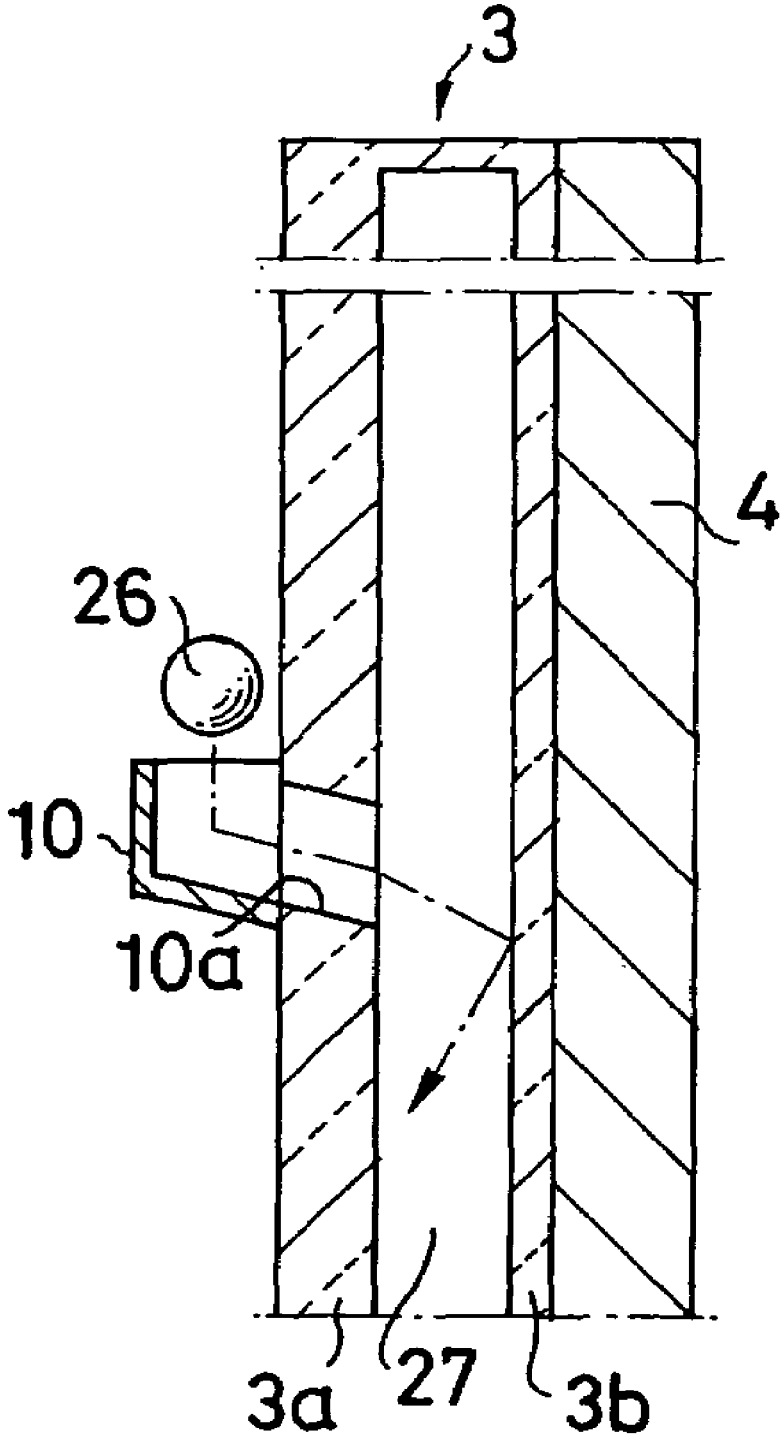
FIG. 4 is a sectional view showing the transparent game board and liquid crystal display device.

With reference to FIG. 4, the relationship between the transparent game board 3 and the liquid crystal display device 4 will now be explained. The transparent game board 3 is constituted by a board part 3*a* having a front face formed with an entrance 10 and the like, and a liquid crystal protecting part 3*b*. Disposed between the board part 3*a* and the liquid crystal protecting part 3*b* is a ball collecting part 27 which is a passage of a game ball 26 for collecting the game ball 26. At the position where the entrance 10 is located, the board part 3*a* is formed with a hole 10*a* for sending the game ball 26 having entered there to the ball collecting part 27. The liquid crystal protecting part 3*b* is provided in order to protect the display screen of the liquid crystal display device 4 against collisions with the game ball 26 having moved to the ball collecting part 27 from the hole 10*a*. When entering the entrance 10, the game ball 26 is detected by a ball entrance detecting switch (not depicted), which will be explained later, disposed within the entrance 10, and is fed to the projecting device 42 (see FIG. 9) through the ball collecting part 27.

Referring to FIGS. 5A to 5C and 6A to 6C, an example of game will now be explained. Though FIGS. 5A to 5C and 6A to 6C show states within the game area, they do not depict members other than the entrances 10*a* to 10*p*, game ball 26, entrance number display areas 17*a* to 17*p*, and game proceeding/result displaying area 18.

Figure 5A:
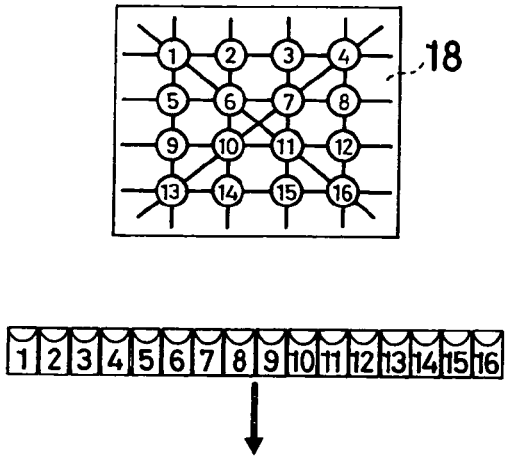
FIGS. 5A to 5C are views showing an example of game.

FIG. 5A shows the state within the game area at the time of starting an arrange ball game. Numbers 1 to 16 are displayed in the entrance number display areas 17*a* to 17*p*, respectively. Also, numbers 1 to 16 are displayed in the online number display areas at addresses $L_{11}$ to $L_{44}$, respectively.

Figure 5B:
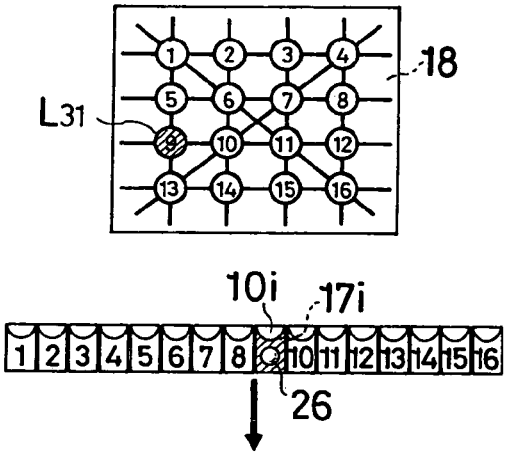

FIG. 5B shows the state where the projected 1st game ball 26 enters the 9th entrance 10*i*. The entrance number display area 17*i* corresponding to the 9th entrance 10*i* is lit. Number 9 is displayed in the entrance number display area 17*i*. Therefore, the online number display area at the address $L_{31}$ displaying number 9 is lit.

Figure 5C:
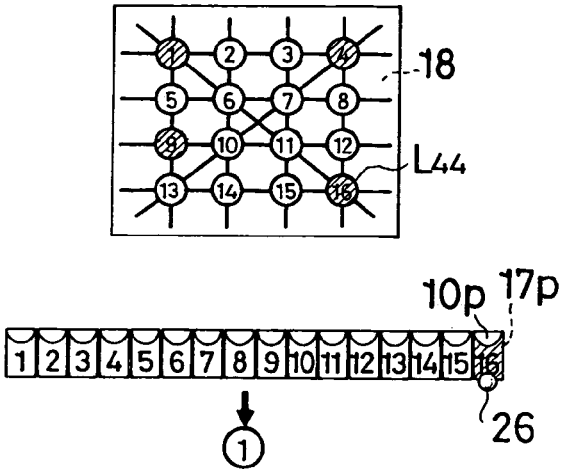

FIG. 5C shows the state where the projected 10th game ball 26 enters the 16th entrance 10*p*. The entrance number display area 17*p* corresponding to the 16th entrance 10*p* is lit. Number 16 is displayed in the entrance number display area 17*p* corresponding to the 16th entrance 10*p*. Therefore, the online number display area at the address $L_{44}$ displaying number 16 is lit.

Figure 6A:
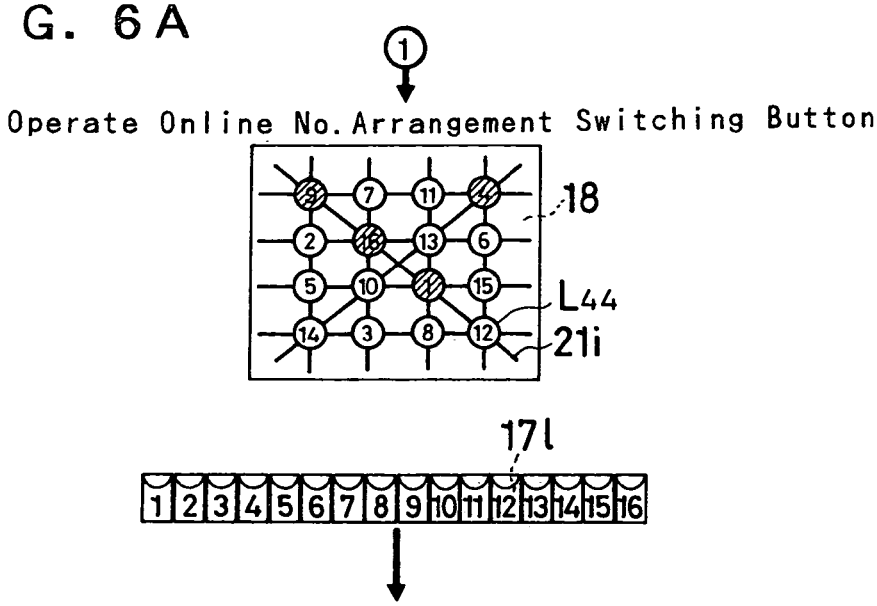
FIGS. 6A to 6C are views showing the game continuing from FIG. 5C.

FIG. 6A shows the state where the online number arrangement changing button 7 is operated after the 10th game ball 26 is projected since the start of the game. The mode of display in the game proceeding/result display area 18 differs from that shown in FIG. 5C in the displayed numbers and lighting (display) of the online number display areas. On the other hand, the numbers displayed by the lit online number display areas are unchanged. Specifically, the state has shifted to one advantageous to the player in which the game will finish if the online number display area at the address $L_{44}$ is lit in the winning line 21*i* (so-called reach state). Here, the operation of the online number arrangement changing button 7 is considered effective for a predetermined period (time clocked by a changing switch allowing timer 51 which will be explained later), i.e., instructions from instructing means are acceptable for the predetermined period. The period considered effective will hereinafter be referred to as "change allowing period".

Figure 6B:
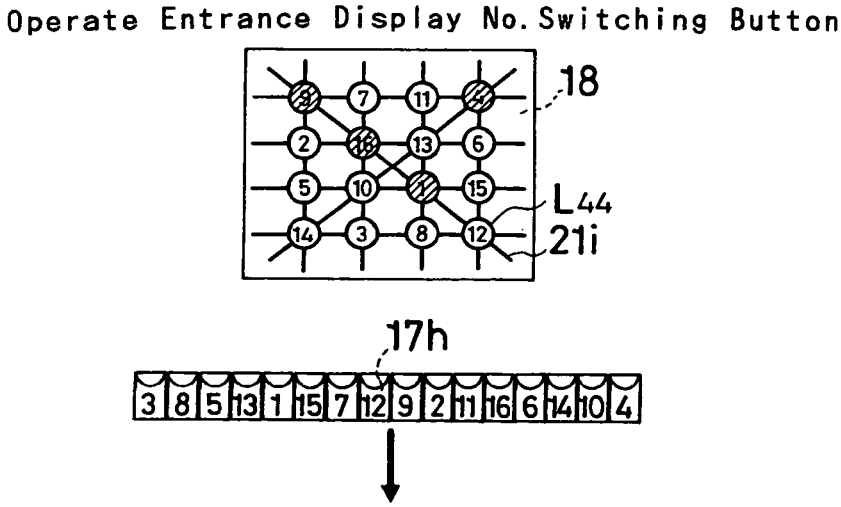

FIG. 6B shows the state where the entrance display number arrangement changing button 6 is operated after the 10th game ball 26 is projected since the start of the game. The display of the entrance number display areas 17*a* to 17*p* differs from that of FIG. 5C or 6A. Number 12 displayed in the online number display area at the address $L_{44}$ in the winning line 21*i* is shown in the 8th entrance number display area 17*h* located closer to the center of the game area than is the 12th entrance number display area 17*l* (shown at an entrance where the ball is more likely to enter).

Figure 6C:
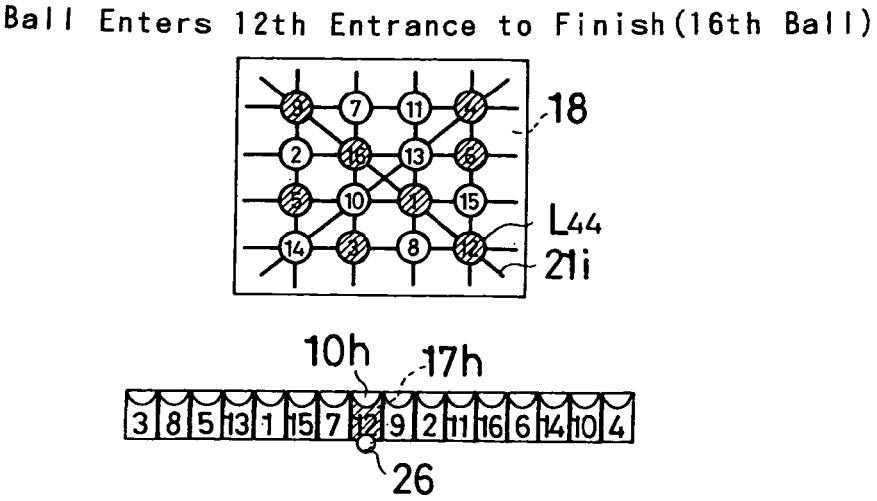

FIG. 6C shows the state where the projected 16th game ball 26 enters the 8th entrance 10*h*. The entrance number display area 17*h* corresponding to the 8th entrance 10*h* is lit. Number 12 is displayed in the entrance number display area 17*h*. Therefore, the online number display area at the address $L_{44}$ displaying number 12 is lit. Hence, all the online number display areas on the winning line 21*i* are lit, thus finishing the game.

Referring to FIG. 7, the entrance corresponding display number storing table will now be explained. This table stores the respective information items of the numbers displayed in the 1st to 16th entrance number display areas 17*a* to 17*p* corresponding to the 1st to 16th entrances 10*a* to 10*p*. This table is used for determining which online number display area to be lit when a game ball enters any entrance 10, and is stored in a work RAM 31*c* which will be explained later.

Referring to FIG. 8, the online address corresponding number storing table will now be explained. This table stores information items indicative of the respective numbers displayed in the online number display areas corresponding to the addresses on the winning lines 21 and whether balls enter there or not (whether the display areas are lit or not). This table is used for regulating the display of the game proceeding/result displaying area 18, determining whether the game is finished or not, and so forth, and is stored in the work RAM 31*c* which will be explained later.

Figure 9:
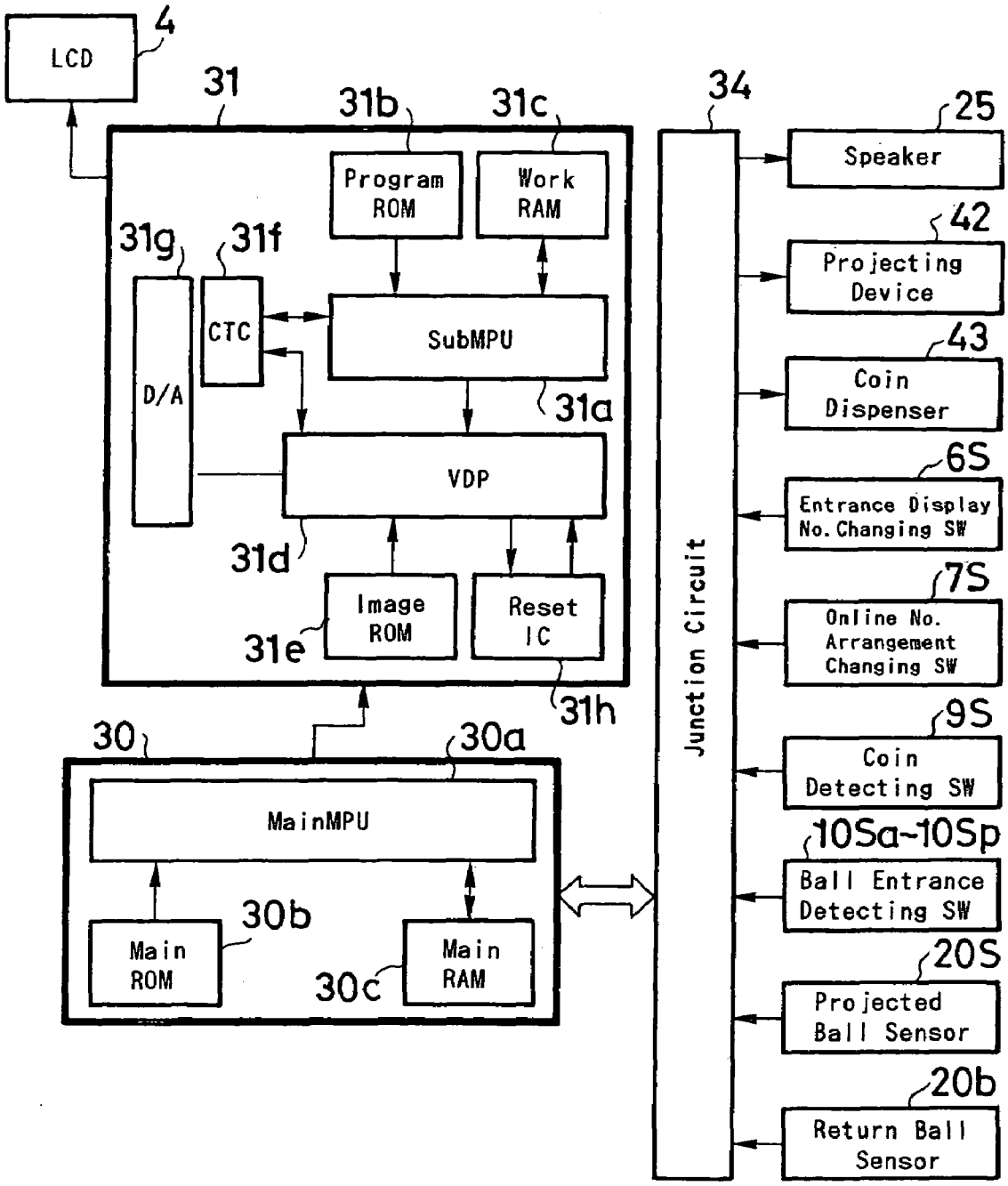
FIG. 9 is a block diagram showing the configuration of an electric circuit in the gaming machine shown in FIG. 1.

FIG. 9 is a block diagram showing the configuration of an electric circuit device in the gaming machine 1. Main operations of the gaming machine 1 are controlled by a main control circuit 30. The main control circuit 30 includes a ROM 30*b* which is read-only storage means storing a control program, a RAM 30*c* which is readable and writable storage means, and an MPU 30*a* acting as an arithmetic processing unit which executes control operations according to the control program stored in the ROM 30*b*, which are arranged on a single circuit board.

The MPU 30*a*, ROM 30*b*, and RAM 30*c* on the main control circuit 30 will be referred to as main MPU 30*a*, main ROM 30*b*, and main RAM 30*c*, respectively, so as to be distinguished from the MPU and the like on a display control circuit 31 which will be explained later. As a periodically occurring reset signal is inputted, the main MPU 30*a* executes the processing of the control program stored in the main ROM 30*b*. Also, the main control circuit 30 regulates the supply of game balls to the projecting device 42.

As shown in FIG. 9, a junction circuit 34 connected to the main control circuit 30 connects with an entrance display number changing switch 6S for detecting operations of the entrance display number changing button 6, an online number arrangement changing switch 7S for detecting operations of the online number arrangement changing button 7, a coin detecting switch 9S for detecting coins inserted in the coin insertion slot 9, respective ball entrance detecting switches 10Sa to 10Sp for detecting game balls having entered 16 entrances 10*a* to 10*p*, a projected ball sensor 20S for detecting game balls projected to the game area from the projecting device 42, and a return ball sensor 20*b* for detecting game balls returning without reaching the game area after being projected from the projecting device 42.

Signals detected by the above-mentioned switches and sensors are fed into the main MPU 30*a* of the main control circuit 30 by way of the junction circuit 34. The main MPU 30*a* carries out various determinations and the like according to thus fed signals, and transmits an operating instruction (command) to the display control circuit 31 and the like. Also connected to the junction circuit 34 are the speaker 25 for outputting sounds concerning games, the projecting device 42 for projecting game balls onto the transparent game board 3, and a coin dispenser 43 for paying out coins according to the operating instruction sent out from the main control circuit 30. These devices and the like are controlled by the main control circuit 30 by way of the junction circuit 34.

The display control circuit 31 generates image data according to the control instruction transmitted from the main control circuit 30, and regulates displaying operations of the liquid crystal display device 4 according to the image data. The display control circuit 31 is constituted by various circuits arranged on a circuit board different from the circuit board arranged with the main control circuit 30. These circuits include a sub MPU 31*a* for interpreting the control instruction received from the main control circuit 30 and setting parameters for a VDP 31*d* which will be explained later, a program ROM 31*b* for storing a control program to be executed by the sub MPU 31*a*, the work RAM 31*c* acting as temporary storage means used when executing the control program, an image ROM 31*e* for storing dot data for forming images, the VDP (Video Display Processor) 31*d* for reading the dot data from within the image ROM 31*e* according to the parameters set by the sub MPU 31*a* and generating image data to be displayed, a D/A converter 31*g* for converting the image data generated by the VDP 31*d* into RGB signals, a CTC (Counter Timer Circuit) 31*f* for making interrupts at predetermined intervals of time, and a reset IC 31*h* for generating a reset order for initializing the sub MPU 31*a* and VDP 31*d* when the control program enters an abnormal processing routine.

Figure 10:
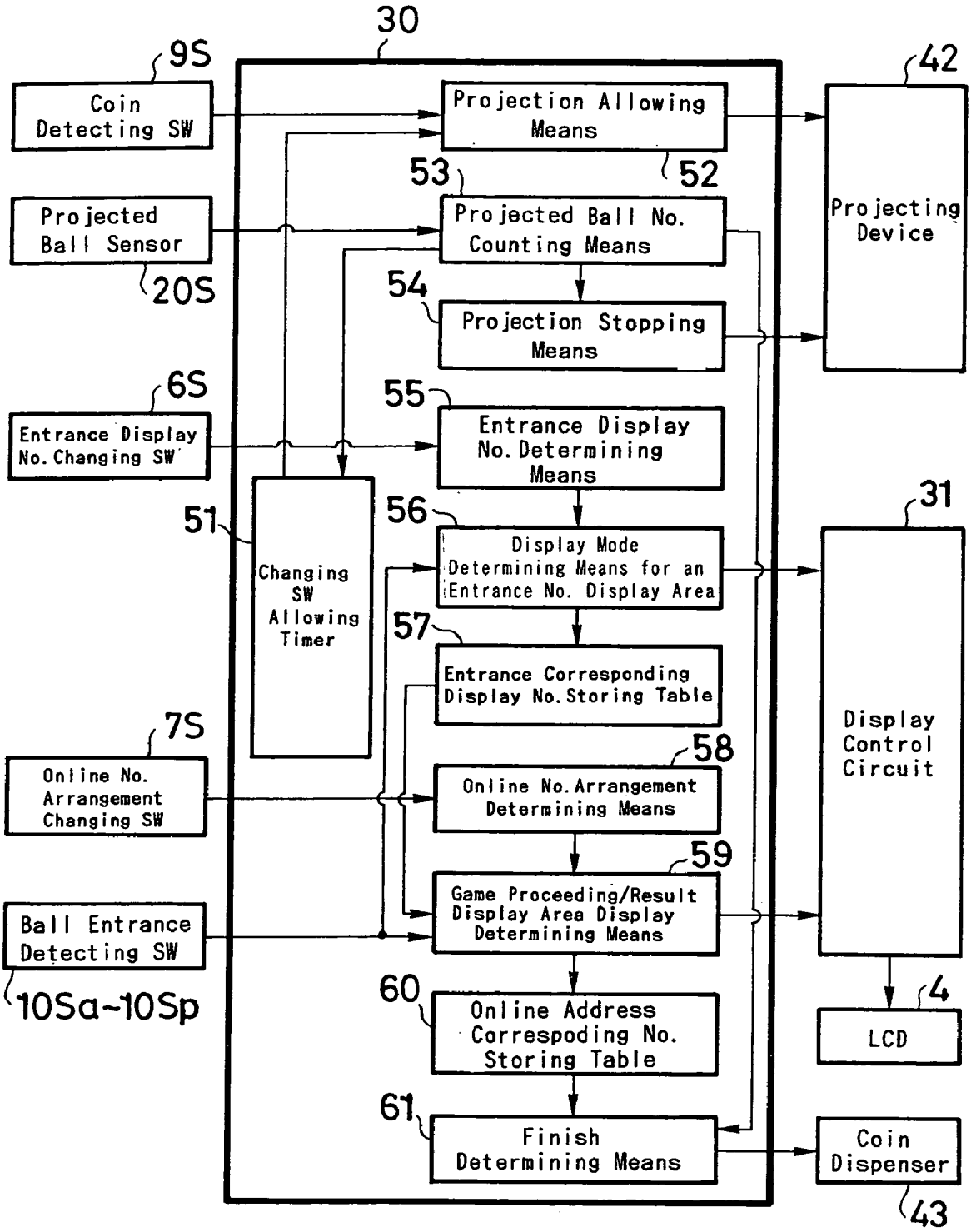
FIG. 10 is a block diagram showing function realizing means (operating device) in the electric circuit shown in FIG. 1.

Referring to FIG. 10, a block diagram including function realizing means (operating device) of the main control circuit 30, which is required for realizing an arrange ball game, will now be explained. The main control circuit comprises:

the changing switch allowing timer 51 for clocking a predetermined time (e.g., 5 seconds) during which input signals from the entrance display number changing switch 6S and online number arrangement changing switch 7S are made effective (acceptable) according to a counted value of a projected ball number counting means 53 which will be explained later (e.g., according to the counted value of 10, which is a specific number);

a projection allowing means 52 for transmitting to the projecting device 42 a signal allowing a game ball to project when there is an input from the coin detecting switch 9S or the above-mentioned predetermined period has passed;

a projected ball number counting means 53 for counting the number of game balls projected according to an input signal from the projected ball sensor 20S;

a projection stopping means 54 for transmitting to the projecting device 42 a signal requesting to stop projecting game balls according to a counted value of the projected ball number counting means 53 (e.g., the counted value of 10 or 16);

an entrance display number determining means 55 for determining the display of the entrance number display areas 17*a* to 17*p* according to a result of random sampling or the like in response to an input signal (instruction) from the entrance display number changing switch 6S;

a display mode determining means for an entrance display area 56 for transmitting a control signal to the display control circuit 31 and updating the information stored in an entrance corresponding display number storing table 57 (FIG. 7) according to the result of determination of the entrance display number determining means 55 or input signals from the ball entrance detecting switches 10Sa to 10Sp;

the entrance corresponding display number storing table 57 shown in FIG. 7;

an online number arrangement determining means 58 for determining the display of the game proceeding/result display area 18 according to a result of random sampling and the like in response to an input signal (instruction) from the online number arrangement changing switch 7S;

a game proceeding/result display area display determining means 59 for transmitting a control signal to the display control circuit 31 and updating the information stored in an online address corresponding number storing table 60 (FIG. 8) according to input signals from the ball entrance detecting switches 10Sa to 10Sp and the information stored in the entrance corresponding display number storing table 57, or the result of determination of the online number arrangement determining means 58;

the online address corresponding number storing table 60 shown in FIG. 8; and a finish determining means 61 for determining whether a game is finished or not according a counted value of the projected ball number counting means 53 (e.g., the counted number of 16) and information about whether balls enter or not at the addresses $L_{11}$ to $L_{44}$ stored in the online address corresponding number storing table 60, and transmitting a control signal to the coin dispenser 43 according to the result of determination.

Referring to main flowcharts shown in FIGS. 11 to 14, control operations of the main MPU 30*a* will now be explained.

Figure 11:
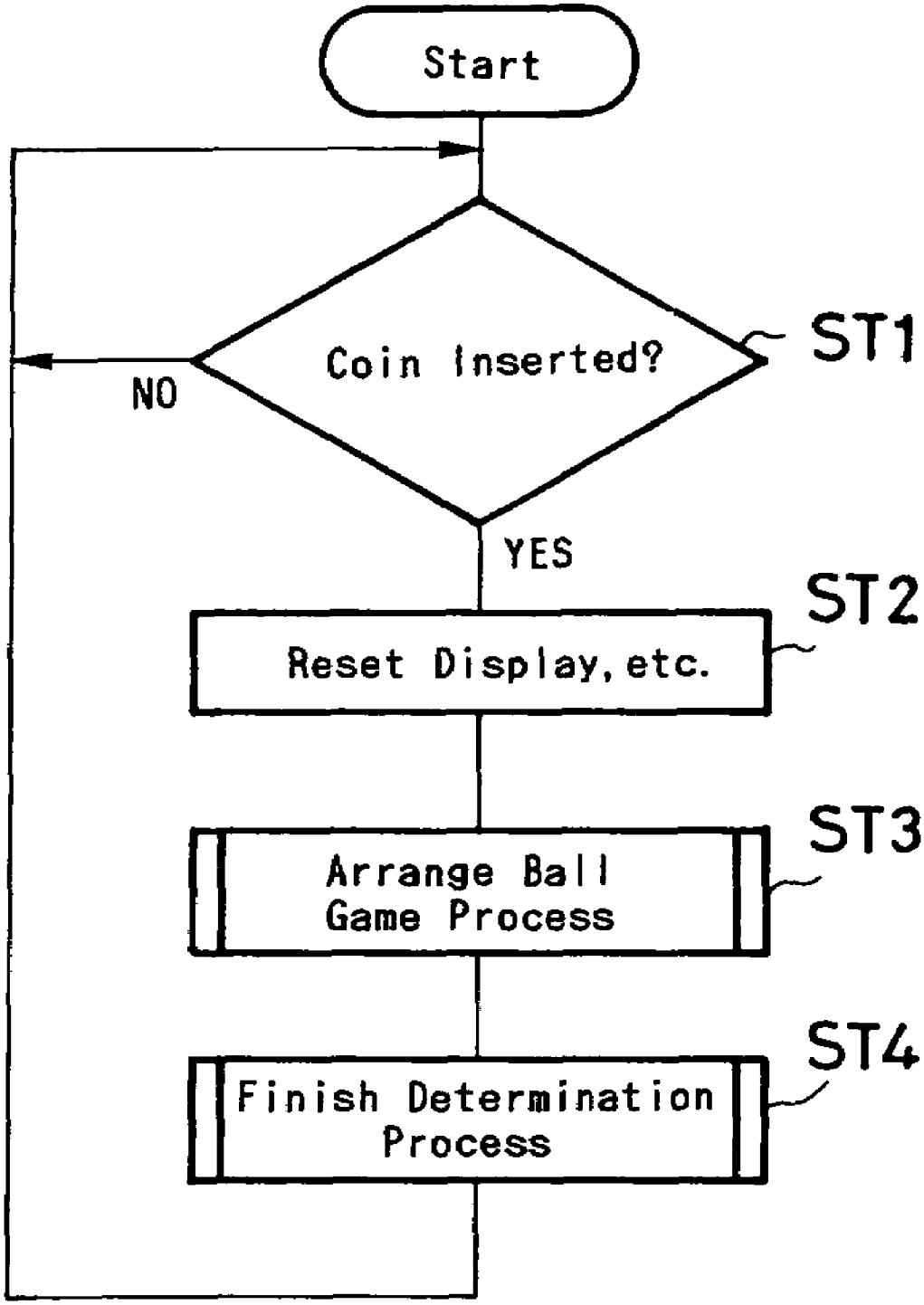
FIG. 11 is a flowchart showing a main game control process.

FIG. 11 shows a main game control process.

Figure 12:
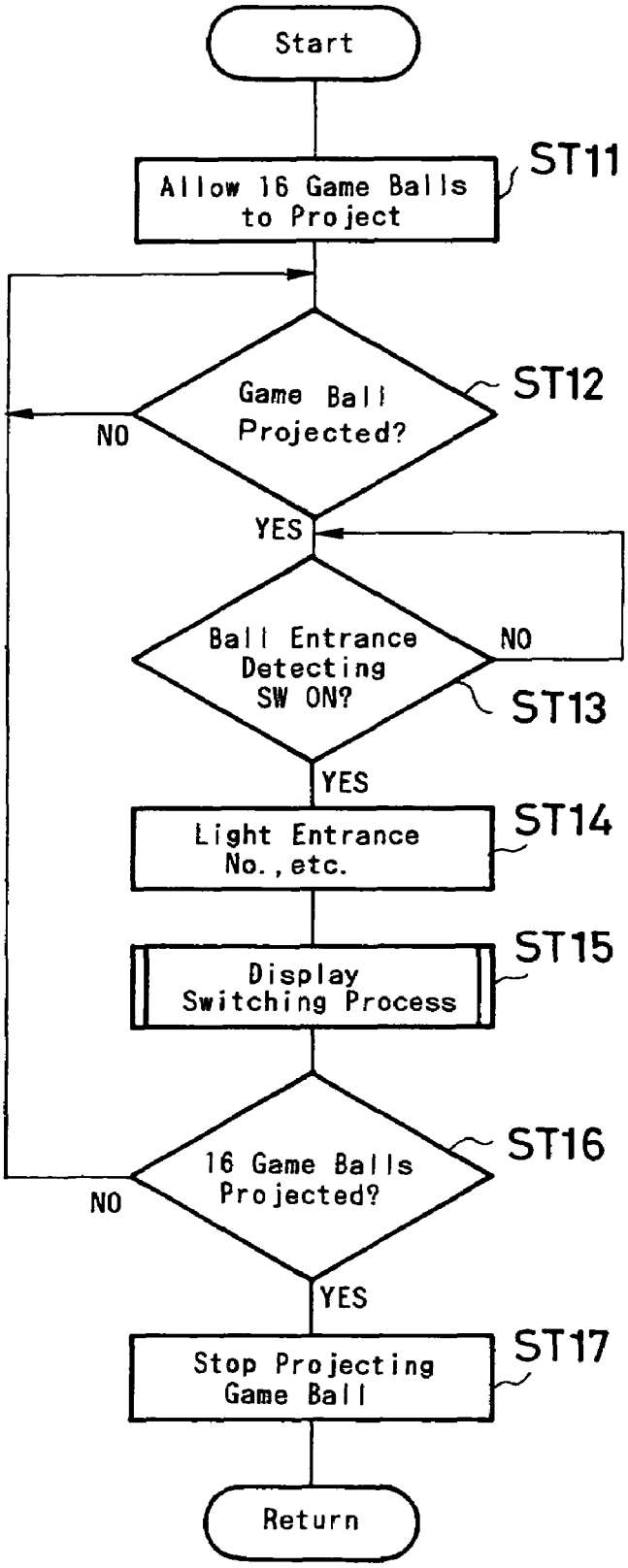
FIG. 12 is a flowchart showing an arrange ball game process.
Figure 14:
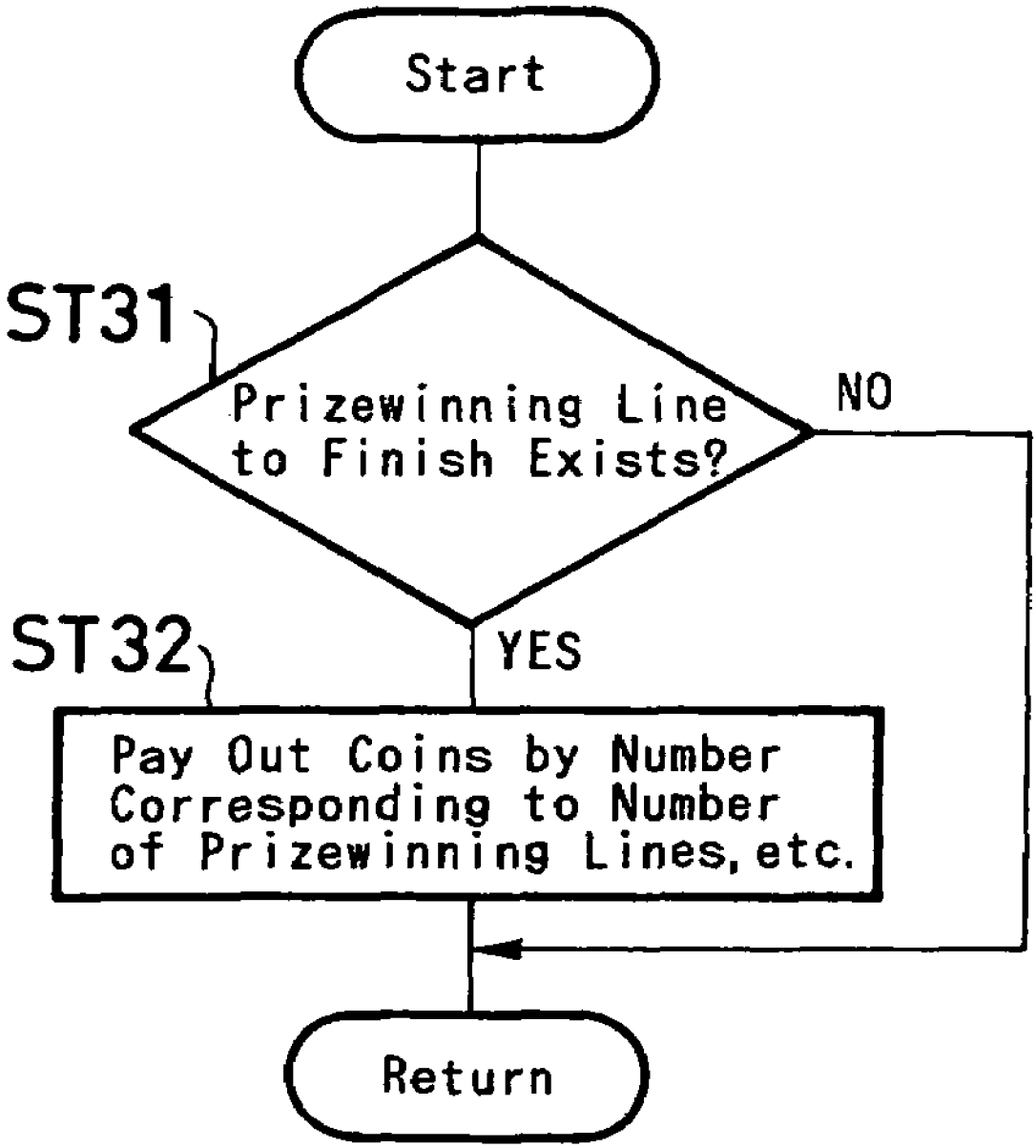
FIG. 14 is a flowchart showing a finish determining process.

First, the main MPU 30*a* determines whether a coin is inserted or not [step (hereinafter referred to as ST) 1). Specifically, it is determined whether there is an input signal from the coin detecting switch 9S or not. If the result of this determination is positive, the display and the like are reset (ST2). Specifically, the entrance display number determining means 55 and online number arrangement determining means 58 determine the display of the entrance number display areas 17*a* to 17*p* and game proceeding/result display area 18. According to the results of these determinations, the entrance number display area display mode determining means 56 and game proceeding/result display area display determining means 59 transmit control signals for resetting the display of the display screen in the liquid crystal display device 4, and update (initialize) the information items stored in the number storing tables 57, 60, respectively. Then, an arrange ball game process, which will later be explained with reference to FIG. 12, is carried out (ST3). Subsequently, a finish determining process, which will later be explained with reference to FIG. 14, is carried out (ST4), and then the flow shifts to ST1.

Referring to FIG. 12, the arrange ball game process will now be explained.

First, the main MPU 30*a* allows 16 game balls to be projected (ST11). Specifically, the projection allowing means 52 transmits to the projecting device 42 a signal to allow projection. Subsequently, it is determined whether a game ball is projected or not (ST12). Specifically, it is determined whether or not there is an input signal from the projected ball sensor 20S. If the result of determination is positive, then it is determined whether any ball entrance detecting switch is ON or not (ST13). Specifically, it is determined whether or not there is an input signal from any of the ball entrance detecting switches 10Sa to 10Sp. If the result of this determination is positive, then the flow shifts to ST14.

At ST14, the entrance number or the like is lit. Specifically, the entrance number display area display mode determining means 56 transmits to the display control circuit 31 a signal requesting to light the entrance number display area 17 corresponding to the entrance 10 having received the game ball. The game proceeding/result display area display determining means 59 determines the number displayed in the entrance number display area 17 corresponding to the entrance 10 having received the game ball according to the entrance corresponding display number storing table 57, transmits a signal requesting to light the online number display area displaying this number to the display control circuit 31, and updates information indicative of whether game balls have entered or not in the online address corresponding number storing table 60. Then, the flow shifts to ST15.

Figure 13:
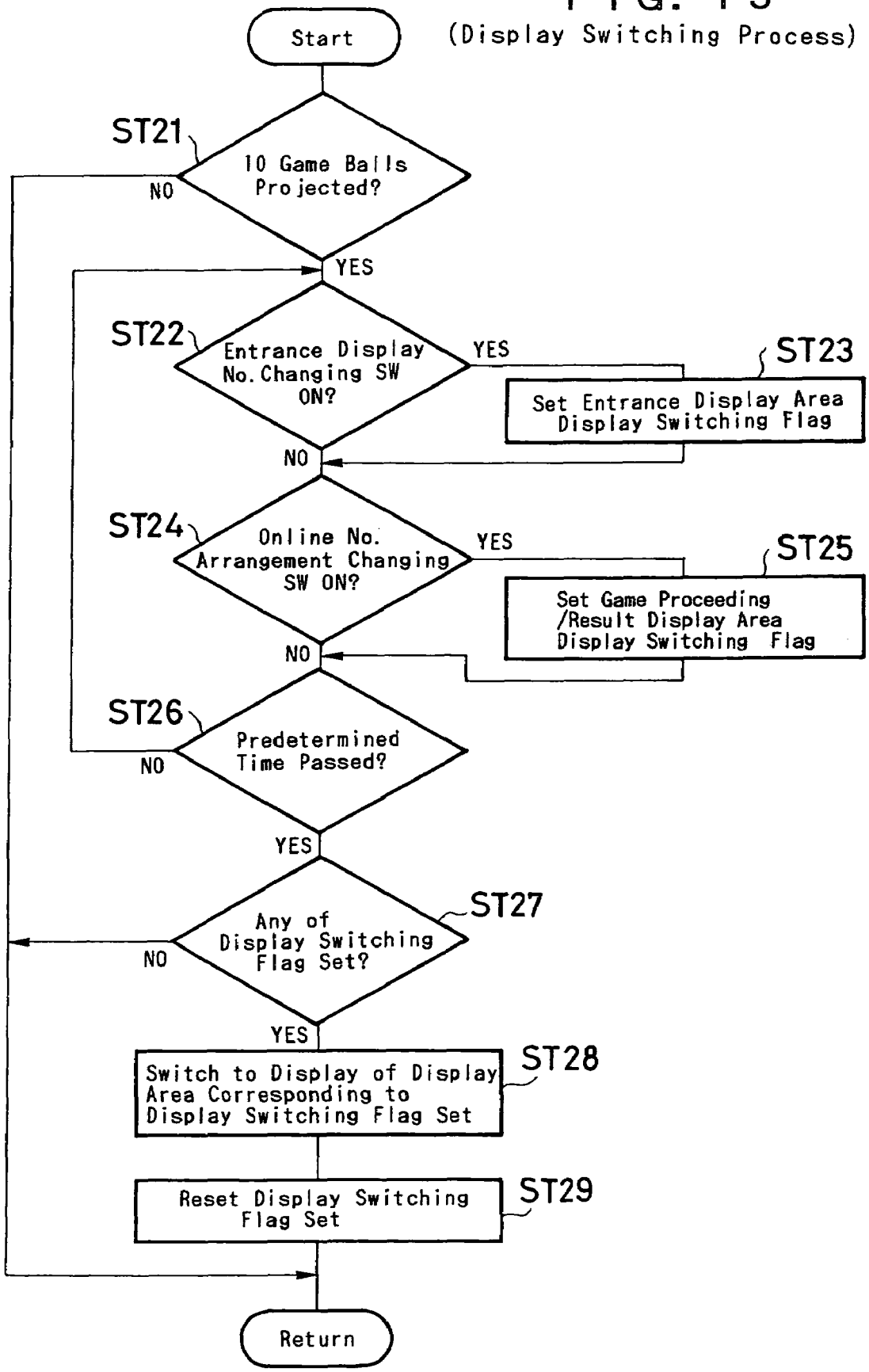
FIG. 13 is a flowchart showing a display switching process.

At ST15, a display switching process, which will later be explained with reference to FIG. 13, is carried out. Subsequently, according to the counted value of the projected ball number counting means 53, it is determined whether 16 game balls have been projected or not (ST16). If the result of this determination is positive, the flow shifts to ST17. If not, the flow shifts to ST12. At ST17, the projection of game balls is stopped. Specifically, the projection stopping means 54 transmits a signal requesting to stop projecting game balls to the projecting device 42. In this case, a game ends, whereby the flow shifts to ST4 in FIG. 11.

Referring to FIG. 13, the display switching process will now be explained.

First, according to the counted value of the projected ball number counting means 53, the main MPU 30*a* determines whether 10 game balls have been projected or not (ST21). If the result of determination is positive, the projection stopping means 54 transmits to the projecting device 42 a signal requesting to stop projecting the game balls, the changing switch allowing timer 51 starts clocking the time during which input signals from the entrance display number changing switch 6S and online number arrangement changing switch 7S are effective, and the flow shifts to ST22. If the result of determination at ST21 is negative, the flow shifts to ST16 in FIG. 12.

At ST22, it is determined whether the entrance display number changing switch 6S is ON or not (whether there is an input or not). If the result of this determination is positive, the flow shifts to ST23. If not, the flow shifts to ST24. At ST23, an entrance display area display switching flag is set. The entrance display area display switching flag is information indicative of the display mode after switching. Specifically, the entrance display number determining means 55 determines the display mode of the entrance number display areas 17*a* to 17*p* according to results of random sampling and the like, and the entrance number display area display mode determining means 56 transmits a control signal to the display control circuit 31 (requests to change the respective numbers to be displayed in the entrance number display areas 17*a* to 17*p*) according to the result of determination. Then, the flow shifts to ST24.

At ST24, it is determined whether the online number arrangement changing switch 7S is ON or not (whether there is an input or not). If the result of this determination is positive, the flow shifts to ST25. If not, the flow shifts to ST26. At ST25, a game proceeding/result display area display switching flag is set. The game proceeding/result display area display switching flag is information indicative of the display after switching. Specifically, the online number arrangement determining means 58 determines the display of the game proceeding/result display area 18 according to the result of random sampling or the like, and the game proceeding/result display area display determining means 59 transmits a control signal to the display control circuit 31 (requests to change the respective numbers or the like displayed in the online number display areas). Subsequently, the flow shifts to ST26.

At ST26, it is determined whether a predetermined time has passed or not. Specifically, according to the time clocked by the changing switch allowing timer 51, it is determined whether a change allowing period has ended or not. If the result of this determination is positive, the flow shifts to ST27. If not, the flow shifts to ST16 in FIG. 12. At ST27, it is determined whether any of the display switching flags is set or not. If the result of this determination is positive, the flow shifts to ST28. If not, the flow shifts to ST16 in FIG. 12. At ST28, the display of the display areas is switched to one corresponding to the set display switching flag. Here, the entrance number display area display mode determining means 56 and game proceeding/result display area display determining means 59 update the information items stored in the entrance corresponding display number storing table 57 and online address corresponding number storing table 60. Subsequently, the set display switching flag is reset (erased) (ST29), and the flow shifts to ST16 in FIG. 12.

Referring to FIG. 14, the finish determining process will now be explained.

First, the main MPU 30*a* determines whether there is a winning line to finish a game or not (ST31). Specifically, according to the information stored in the online address corresponding number storing table 60, the decision is made by the finish determining means 61 when the counted value of the projected ball number counting means 53 reaches 16. For example, when all the information items concerning whether the game balls have entered or not corresponding to the addresses $L_{11}$, $L_{22}$, $L_{33}$, $L_{44}$ on a line are positive, the result of the determination at ST31 becomes positive. If the result of determination at ST31 is positive, the flow shifts to ST32. If not, the flow shifts to ST1 in FIG. 11. At ST32, the finish determining means 61 transmits a signal requesting to pay out coins by the number corresponding to the number of winning lines or the kind of winning lines to the coin dispenser 43. Then, the flow shifts to ST1 in FIG. 1.

Though one embodiment is explained in the foregoing, the present invention is not restricted thereto.

Though the change allowing period is a period until a predetermined time passes after a specific number of (10) game balls are projected in the above-mentioned embodiment, the present invention is not restricted thereto. For example, it may be a period until the projecting device 42 projects a game ball after the projection allowing means 52 allows the game ball to be projected in response to the insertion of a coin. Also, a predetermined period can be generated when a predetermined number of (16) game balls allowed to be projected in a game are projected.

Though the online number arrangement changing button 7 and the entrance display number changing button 6 are provided as instructing means for the game proceeding/result display area (first display area) 18 and entrance number display areas (second display areas) 17*a* to 17*p* in the above-mentioned embodiment, the present invention is not restricted thereto. For example, a single instructing means for changing the display of both of the first and second display areas may be provided. Also, instructing means which can change the display of one of the first and second display areas may be provided. Namely, instructing means for making an instruction to change the display of at least one of the first and second display areas may be provided.

Though each entrance 10 is provided with a hole 10*a* for sending the received game ball 26 to the ball collecting part 27 in the above-mentioned embodiment, the present invention is not restricted thereto. Each entrance 10 may be constituted by a through port (so-called through checker), and a port (so-called outlet) for sending the game ball passing through the through port to the ball collecting part 27 may be provided below the position where the entrance 10 of the board part 3*a* is disposed. This makes it unnecessary to provide the hole 10*a* for each entrance 10, whereby an inexpensive gaming machine can be provided.

In the above-mentioned embodiment, a plurality of patterns of the display in the entrance number display areas 17*a* to 17*p* and the display in the game proceeding/result display area 18 are stored, and random sampling is carried out according to operations of the entrance display number changing button 6 and online number arrangement changing button 7, so as to choose one of the patterns, and the display is effected according to thus chosen pattern. However, the present invention is not restricted thereto. For example, whether the display of these display areas is made advantageous to the player or not may be determined according to results of random sampling and the like, and the above-mentioned pattern may be decided according to the result of determination.

Specifically, whether the display is made advantageous to the player or not is determined by random sampling when the entrance number display changing button 6 or online number arrangement changing button 7 is operated. When it is determined that the display is made advantageous to the player, a pattern of the display of the entrance number display areas 17*a* to 17*p* in which a second identification information item corresponding to a first identification information item (one displayed in conformity to the entrance receiving no ball) disposed on a winning line yielding a high possibility of finishing the game (e.g., a winning line in a reach state) is displayed so as to correspond to an entrance having a higher possibility of receiving a ball, or this second identification information item is displayed so as to correspond to a plurality of entrances may be chosen. When no reach state occurs, a pattern of the display of the game proceeding/result display area 18 generating a reach state according to information stored in the online address corresponding number storing table 60 may be chosen as well.

Selecting means for the player to select a change allowing period may also be provided. For example, the above-mentioned specific number may be made selectable by the player. In this case, the probability of the display of the entrance number display areas 17*a* to 17*p* or the display of the game proceeding/result display area 18 becoming advantageous to the player after changing may be made higher as the selected specific number is greater. Also, selecting means for the player to select the predetermined number may be provided. In this case, the probability of finishing the game increases as the predetermined number is greater, whereby the number of coins required for playing one game can be changed according to the predetermined number (e.g., the number of required coins is increased as the predetermined number is greater). This can provide a gaming machine with a range of playability.

Though the entrance number display areas 17*a* to 17*p* and game proceeding/result display area 18 after being changed display numbers one by one in the above-mentioned embodiment, the present invention is not restricted thereto. For example, a specific number may be displayed a plurality of times in one or both of these areas. This can change the degree of advantage to the player. When this specific number corresponds to a plurality of entrances adjacent each other, the specific number may be displayed in a plurality of entrance number display areas.

Though the above-mentioned embodiment employs the lapse of a predetermined time as a condition for terminating the change allowing period, the present invention is not restricted thereto. For example, any of the manipulation of an operating device for terminating the change allowing period, a predetermined number of operations (pushing operations) of at least one of the entrance display number changing button 6 or online number arrangement changing button 7, a specific number of the sum of operations of these two buttons, and an operation of the shooting handle 24 by the player may be employed. Also, an upper limit may be set for the number by which each of the entrance display number changing button 6 and online number arrangement changing button 7 is operable (the number by which operations are considered effective). The display of both the entrance number display areas 17*a* to 17*p* and game proceeding/result display area 18 may be made changeable by manipulating an operating device as well.

The specific number, predetermined number, predetermined mode (display mode) in the game proceeding/result display area 18, number of winning lines, number of entrances, number of online number display areas, and kind (number) of identification information items are not restricted to those of the above-mentioned embodiment, but may be selected arbitrarily. The number of entrances and the number of online number display areas may differ from each other as well.

Signals from the entrance detecting switches 10Sa to 10Sp may wirelessly be fed into the main control circuit 30. When inputting the signals by wire, it is preferred that patterns and the like be drawn on the transparent game board 3 so that the wiring on the backside of the transparent game board 3 is invisible to the player.

The picture display area may display not only still pictures, but also any images (moving pictures). For example, a displayed image such as character may be moved from an entrance number display area corresponding to an entrance having received a game ball to an online number display area displaying the number shown by this area by way of the picture display area. This can display the relationship between the entrance number display area and the game proceeding/result display area or the like, thereby enhancing the joy of playing the game.

Though the above-mentioned embodiment uses the liquid crystal display device 4 as display means, the present invention is not limited thereto. For example, the display means may be constituted by a display device in which a number of LEDs are arranged, light-emitting means such as lamp, and other electric display devices such as CRT, plasma display, and electroluminescence display. A display device having the entrance number display areas 17*a* to 17*p* and a display device having the game proceeding/result display area 18 may be provided separately from each other. Namely, two display devices may be provided. In this case, a nontransparent game board may also be used.

The present invention is also applicable to a game program. The game program is carried by a recording medium such as ROM cartridge, CD-ROM, and DVD, or distributed via a network such as the Internet and satellite communications. This game program can make a computer realize the steps of displaying a game board onto a predetermined display device; displaying a game ball moving on the game board; displaying a plurality of entrances adapted to receive the game ball; displaying on the game board a first display area for displaying a plurality of first identification information items in a predetermined mode and a second display area adapted to display a second identification information item corresponding to the first display area and entrances; and receiving an instruction from instructing means for a predetermined period, and changing at least one of the first and second display areas according to thus received instruction.

The above-mentioned steps may be executed by a video game controller or a computer such as PC, so as to display the image of the whole game area including the game proceeding/result display area 18 and the like of the liquid crystal display device 4 onto an image monitor of the computer, and allow the player to enjoy playing a virtual game while manipulating specific keys on a keyboard substituting for various buttons such as the entrance display number changing button 6 and the online number arrangement changing button 7, the shooting handle 24, and an operating switch constituted by a dedicated operating button.

What is claimed is:

1. A gaming machine comprising:

a game board formed from a light-transparent member;

a game medium projecting device for projecting a game medium onto the game board;

a plurality of entrances adapted to receive the game medium projected onto the game board;

a display device having a first display area for displaying a plurality of first identification information items in a predetermined mode and a second display area adapted to display respective second identification information items corresponding to the entrances, the display device being disposed such that the first and second display areas are viewable through the game board;

an instructing device for making an instruction to change the display of at least one of the first and second display areas; and a display changing device for receiving the instruction from the instructing device for a predetermined period and changing the display according to thus received instruction.

2. A gaming machine according to claim 1, wherein the first identification information items comprise at least one of numbers, letters, and characters.

3. A gaming machine according to claim 1, wherein the predetermined mode is a two- or three-dimensional display mode.

4. A gaming machine according to claim 1, wherein the first display area is an area displaying a plurality of identification information items at respective addresses in a matrix of 4 by 4.

5. A gaming machine according to claim 1, wherein the first display area is a game proceeding/result display area.

6. A gaming machine according to claim 1, wherein the second display area is an entrance number display area.

7. A gaming machine according to claim 1, wherein the display device is a liquid crystal display device.

8. A gaming machine according to claim 1, wherein the display of at least one of the first and second display areas comprises respective identification information items displayed at individual addresses or respective identification information items corresponding to the individual entrances.

9. A gaming machine according to claim 1, wherein the instructing device is an online number arrangement changing button or entrance display number changing button operable by a player.

10. A gaming machine according to claim 1, wherein the predetermined period is a period during when the display can be changed, the period being started from when the game medium is allowed to project or when the game medium is projected.

11. A gaming machine according to claim 1, wherein the display changing device comprises an online number arrangement determining device and a game proceeding/result display area display determining device.

12. A gaming machine according to claim 1, wherein the display changing device comprises an entrance display number determining device and a display mode determining device for an entrance number display area.

13. A gaming machine according to claim 1, further comprising:

a gaming value providing device for providing a player with a gaming value; and a projection allowing device for allowing a predetermined number of game media to project in a game unit for projecting the predetermined number of game media onto the game board;

wherein the mode of displaying the first identification information item corresponding to the second identification information item corresponding to the entrance having received the game medium during the game unit is changed in the first display area; and wherein the gaming value providing device provides the player with the gaming value according to the display of the first display area in the game unit.

14. A gaming machine according to claim 13, wherein the gaming value providing device is a coin dispenser.

15. A gaming machine according to claim 13, wherein the first identification information item is a number or letter identical to a number or letter of the second identification information item.

16. A gaming machine according to claim 13, wherein the change in the mode of displaying the first identification information item is lighting in an online number display area of an address displaying the first identification information item.

17. A gaming machine according to claim 13, wherein the gaming value is provided according to a determination of a finish determining device for determining whether a game is finished or not according to information stored in an online address corresponding number storing table.

18. A gaming machine according to claim 13, wherein the predetermined period is a period after the projection allowing device allows a game medium to project until the game medium projecting device projects the game medium.

19. A gaming machine according to claim 13, wherein the predetermined period is started when the game medium projecting device projects a specific number of game media.

20. A gaming machine according to claim 19, wherein the specific number is the same as the predetermined number.

21. A gaming machine according to claim 1, wherein the predetermined period is started when the game medium projecting device projects a specific number of game media.

22. A gaming machine according to claim 21, wherein the specific number is the same as the predetermined number.

23. A gaming machine according to claim 1, wherein the display changing device changes the display of at least one of the first and second display areas to a display advantageous to the player in response to an instruction from the instructing device.

24. A gaming machine comprising:

a game board formed from a light-transparent member;

game medium projecting means for projecting a game medium onto the game board;

a plurality of entrances adapted to receive the game medium projected onto the game board;

display means having a first display area for displaying a plurality of first identification information items in a predetermined mode and a second display area adapted to display respective second identification information items corresponding to the entrances, the display means being disposed such that the first and second display areas are viewable through the game board;

instructing means for making an instruction to change the display of at least one of the first and second display areas; and display changing means for receiving the instruction from the instructing means for a predetermined period and changing the display according to thus received instruction.

* * * * *